US005492221A

United States Patent [19]

Light et al.

[11] Patent Number: 5,492,221

[45] Date of Patent: Feb. 20, 1996

[54] LIGHT-TIGHT PACKAGE

[75] Inventors: Susan L. Light, Webster; John A. Spina, Rochester; John DePoint, Jr., Palmyra, all of N.Y.

[73] Assignee: Eastman Kodak Company, Rochester, N.Y.

[21] Appl. No.: 333,391

[22] Filed: Nov. 2, 1994

[51] Int. Cl.[6] ..... B65D 85/67

[52] U.S. Cl. ..... 206/398; 206/410; 206/414; 206/813

[58] Field of Search ..... 206/389, 397, 206/398, 400, 410, 413, 414, 415, 416, 813

[56] References Cited

U.S. PATENT DOCUMENTS

| | | | |
|---|---|---|---|
| 2,883,045 | 4/1959 | Abramson | 206/59 |
| 3,215,334 | 11/1965 | Neal, Jr. et al. | 206/410 X |
| 3,895,711 | 7/1975 | Hiltunen et al. | 206/413 |
| 4,137,690 | 2/1979 | Morgan | 53/176 |
| 4,148,395 | 4/1979 | Syracuse et al. | 206/414 |
| 4,505,387 | 3/1985 | Seto | 206/414 |
| 4,733,777 | 3/1988 | Van Geyte et al. | 206/316 |
| 4,911,299 | 3/1990 | Peeters | 206/410 |
| 5,049,928 | 9/1991 | Tirone | 206/414 X |
| 5,133,171 | 7/1992 | Chase et al. | 53/409 |
| 5,174,095 | 12/1992 | Fujiwara et al. | 53/480 |
| 5,222,601 | 6/1993 | Takahashi et al. | 206/416 |

FOREIGN PATENT DOCUMENTS 191046 12/1991 Belgium .

OTHER PUBLICATIONS

"Scotch Differential Tack", 3M Product Information, Undated, (70–0702–9909–7 (20.5)R1 (BL–vf112596).

*Primary Examiner*—Jacob K. Ackun
*Attorney, Agent, or Firm*—Charles E. Snee, III

[57] ABSTRACT

An improved light-tight package for a roll (10) of a length (14) light-sensitive material such as photographic film or paper includes an opaque leader (22) provided with adhesive elements (44, 46) which adhere more strongly to the leader that to folded-over portions (58, 60) of opaque end disks (32, 34). Alternatively, adhesive elements (56) having similar properties may be applied to the end disks. Upon unrolling of the package by pulling the leader, the end disks release from the adhesive elements without tearing; and the adhesive elements remain attached to the leader and are removed from the roll with the leader.

7 Claims, 2 Drawing Sheets

LIGHT-TIGHT PACKAGE

TECHNICAL FIELD

The invention concerns packages for rolls of web material. More particularly, the invention concerns a light-tight package suitable for use with sensitized goods such as rolls of photographic paper and film.

BACKGROUND ART

Currently rolls of photographic film and paper are packaged in several different ways to facilitate room light loading into cooperating apparatus which dispenses or otherwise uses the film or paper. Commonly assigned U.S. Pat. No. 4,148,395 discloses a package which includes a pair of flexible opaque end disks or covers attached to the ends of the core of the roll and an opaque leader attached to the leading end of the length of film or paper forming the roll. A peripheral portion on each end disk is folded over and adhered to the edge of an underlying convolution of the leader. A layer of adhesive is provided on the peripheral lip. When the leader is pulled away from the packaged roll, the end disks tear circumferentially at the edge of the roll; so that, the peripheral portions remain adhered to the leader. However, the tearing of the end disk can result in the generation of dust and fibers which can contaminate the product. In addition, the tearing of the end disks does not always proceed neatly along the circumferential edge of the roll; so that, ragged edges sometimes are formed which can interfere with proper dispensing of the product from the package.

Commonly assigned U.S. Pat. No. 5,133,171 discloses a package which includes a pair of similar end disks and a leader. After a first convolution of the leader is wrapped onto the roll, peripheral portions of the end disks are folded over the first convolution. A second convolution is then wrapped onto the roll to capture the folded-over peripheral portions between the first and second convolutions. Friction is relied upon to retain the folded-over portions between the convolutions of leader and no adhesive is used. However, the frictional engagement between the folded-over portions and the convolutions of the leader occasionally is not sufficient to prevent the folded-over portions from slipping at least partially free, thereby permitting entry of light and causing damage to the product. Moreover, after the leader is pulled from the package, the relatively stiff end disks sometimes tend to catch on the product being dispensed or on the cooperating cassette or apparatus, leading to increased pull forces, jamming of equipment and potential loss of quality of the ultimate photographic image.

U.S. Pat. No. 4,137,690 discloses an apparatus for wrapping large rolls of paper in which a double-sided tape is used to hold folded-over peripheral portions of end disks onto the outer convolution of the roll. Since the tape adheres equally to the end disks and the outer convolution, the end disks would tend to tear upon unwinding the roll, with the disadvantages mentioned in the previous paragraph.

SUMMARY OF THE INVENTION

The primary objective of our invention is to provide an improved light-tight package which remains properly closed until opened for use.

Another objection of our invention is to provide such a package whose elements do not interfere with dispensing of the product after opening of the package.

A further objective of our invention is to provide such a package which does not generate contaminating fibers or dirt when opened.

A still further objective of our invention is to provide such a package in which no adhesive remains near the roll after opening of the package, thereby preventing contamination of the edges of the product or the cooperating apparatus with adhesive.

These objectives are given only by way of illustrative examples; thus other desirable objectives and advantages inherently achieved by the disclosed invention may occur or become apparent to those skilled in the art. Nonetheless, the scope of the invention is to be limited only by the appended claims.

Our invention is defined by the claims. A light-tight package is provided for a roll of light-sensitive web material. The roll includes a core with opposite ends and a length of the web wound about the core. The roll has end surfaces at the opposite ends of the core. The length of web material has a first width and a leading end. The package includes a flexible opaque leader wound about the roll through at least a first convolution, the leader having a trailing end attached to the leading end, a second width substantially equal to the first width, a length greater than a circumference of the roll and opposite lateral edges separated by the second width. A pair of flimsy, flexible opaque end disks cover the end surfaces, a central portion of each end disk being attached to the core and a peripheral portion of each end disk being folded over a circumferential edge of the first convolution of the leader. Uniquely in accordance with our invention, a pair of adhesive elements are located respectively between (a) each lateral edge substantially along the first convolution of the leader and (b) the folded-over peripheral portion of each end disk. Each adhesive element has a property of adhering much more strongly to the leader than to the folded-over peripheral portion of the end disk. The material of the end disks, though flimsy to minimize interference with unrolling of the web material, has sufficient tensile strength to resist tearing before the adhesive elements release from the folded-over portions upon unrolling of the leader. As a result, upon unrolling of the package by pulling the leader, the end disks release from the adhesive elements without tearing; and the adhesive elements move away from the roll with the leader.

The leader may have a length greater than twice the circumference of the roll to permit a second convolution to be wound onto the package for improved light-tightness. In such event, each lateral edge of the leader may include a recess extending inwardly toward a center line of the leader, each recess being spaced from the trailing end by a distance substantially equal to the circumference of the roll, the recesses providing clearance for the second convolution of the leader to pass the folded over peripheral portions of the end disks. The adhesive elements may comprise lengths of double-sided adhesive tape or other adhesives having the described properties. The adhesive elements may be applied to the end disks or to the leader, prior to folding the peripheral portions.

A package according to our invention provides important advantages over prior art packages. The use of adhesive elements having the properties just described ensures that the end disks will remain securely attached to the leader to provide a light-tight package before the package must be opened. When a roll wrapped in accordance with our invention is placed in a cassette or other cooperating apparatus and the strip of leader is removed to open the package, the adhesive elements remain with the leader because the end disks lift or peel away from the adhesive elements as the leader is pulled away. The end disks are not torn during use; so, generation of fibers and dirt is minimized. Since the adhesive elements remain on the leader, there is no opportunity for contamination of the product by the adhesive. And, as the leader is removed, the exposed, relatively lower tack portions of the adhesive elements tend not to adhere to the cassette or the cooperating apparatus. Because the adhesive elements adhere lightly to the end disks, the pull force to remove the leader is not increased substantially over that of prior art packages. Once the leader is removed, because the end disks are flimsy, they tend to untold away from the roll to facilitate dispensing of the product and do not interfere with the dispensing or with the structure of the cooperating cassette or other apparatus.

BRIEF DESCRIPTION OF THE DRAWINGS

The foregoing and other objectives, features and advantages of the invention will be apparent from the following more particular description of the preferred embodiments of the invention, as illustrated in the accompanying drawings.

DESCRIPTION OF THE PREFERRED EMBODIMENTS

Figure 1:
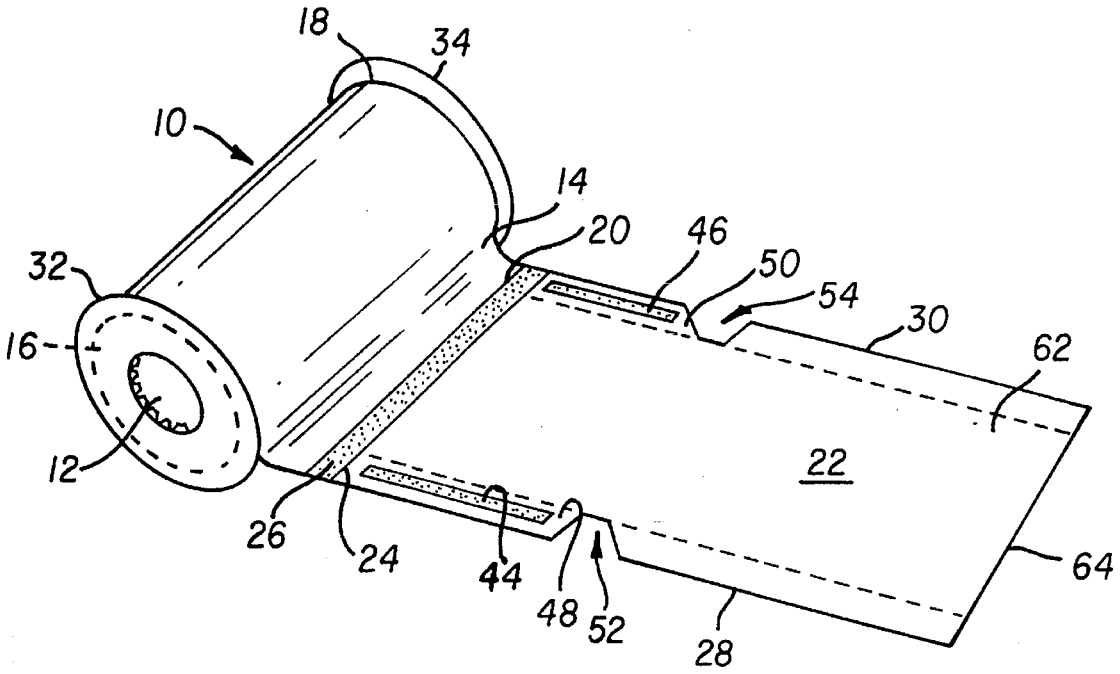
FIG. 1 illustrates schematically a perspective view of a roll of web material with a leader attached to the leading edge of the web, the leader bearing adhesive elements in accordance with our invention.
Figure 2:
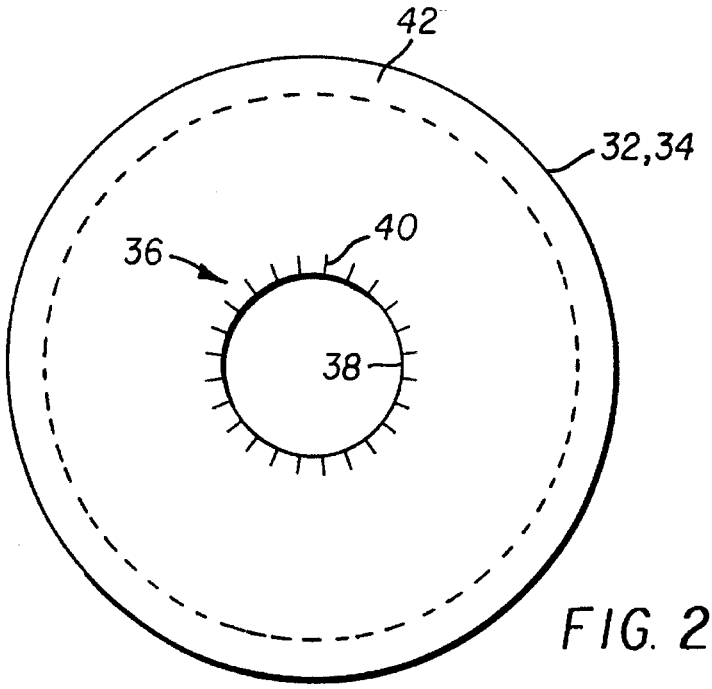
FIG. 2 illustrates a plan view of an end disk suitable for use in the package according to our invention.
Figure 3:
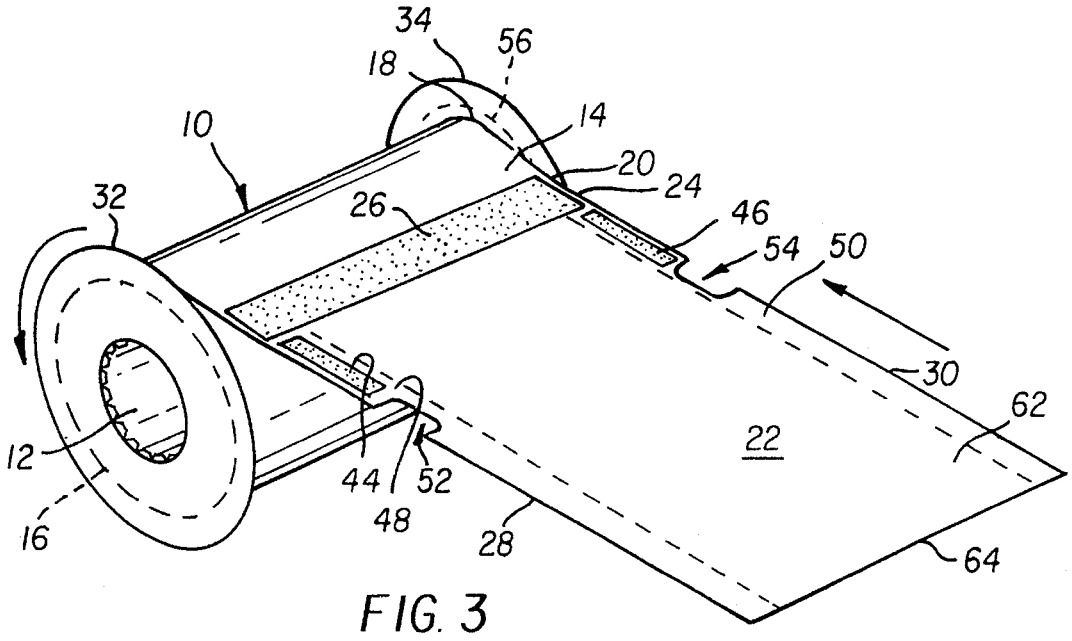
FIG. 3 to 5 illustrate schematically the sequential steps of assembling a package in accordance with our invention.

The following is a detailed description of the preferred embodiments of the invention, reference being made to the drawings in which the same reference numerals identify the same elements of structure in each of the several Figures.

Referring simultaneously to FIGS. 1 to 5, the salient features of our invention can be understood. A roll 10 of light-sensitive web material includes a central, typically flangeless, hollow core 12 having opposite ends and a length approximately equal to the width of a length 14 of such web material. Length 14 is wound onto core 12; so that, in the familiar manner, the wound roll 10 has opposite end surfaces 16, 18. The leading end 20 of length 14 is joined to a flexible, opaque leader 22 having a trailing end 24, a width approximately equal to the length of core 12 and a length at least as long as the circumference of roll 10. Leader 22 may be made from various opaque materials, such as polyester containing carbon black or rubber modified high density polyethylene containing carbon black. A suitable carbon black content would be in the range of 3 to 8% by weight. A thickness for leader 22 in the range of 0.003 to 0.008 inch (0.076 to 0.203 ram) will ensure suitable tensile strength. Preferably, leader 22 has a length sufficient to apply two convolutions of leader about roll 10 for greater light-tightness. A strip 26 of tape may be used to join ends 14, 24. Leader 22 has longitudinally extended lateral edges 28, 30.

A pair of flexible, opaque end disks 32, 34 cover end surfaces 16, 18. Each disk includes a central portion 36 with a hole 38 somewhat smaller in diameter than an internal diameter of core 12. Preferably, end disks 32, 34 are made from an opaque but thin and flimsy material which has adequate tensile strength to resist tearing when the completed package is opened. Extended radially outward from hole 38 are a plurality of radial cuts 40 through the thickness of the disk to facilitate attachment to the core. As shown in the figures, the portions of the disks between cuts 40 are folded into core 12 in the familiar way and secured there using any suitable adhesive. A peripheral portion 42 of each end disk extends somewhat beyond the diameter of roll 10.

End disks 32, 34 may be made from any suitable opaque, thin gauge material having adequate tensile strength to resist tearing when the package is opened, but only modest stiffness. That is, in addition to being opaque and having a certain tensile strength, the material should be flimsy to minimize interference with the product or adjacent structure during opening of the package or unwinding of the roll. One suitable material would be a lamination including an outer layer of 0.001 inch (0.025 mm) thick white, opaque, high density polyethylene-low density polyethylene blend extrudate; a second layer of 0.003 inch (0.076 mm) thick linear low density polyethylene film containing carbon black; and a third layer comprising a coextrusion of 4 pound ethylene vinyl acetate and 16 pound surlyn extrudate, approximately 0.00125 inch (0.032 mm) thick. The overall thickness of the lamination may be in the range of 0.002 to 0.005 inch (0.051 to 0.127 mm) to ensure that the end disks have adequate tensile strength to resist tearing when the leader is removed but also are suitably flimsy. The carbon black content may be as for leader 22. In use, the inner layer would face roll 10. Other suitable materials for end disks 32, 34 include any suitable plastic film or lamination which could include polypropylene, Cellophane, Nylon, polyester and various combinations thereof which are opaque, flimsy and have adequate tensile strength to resist tearing during use in the package according to our invention.

A pair of elongated adhesive elements 44, 46 are attached to a pair of opposed, transversely and longitudinally extended marginal portions 48, 50 of leader 22. Adhesive elements 44, 46 preferably begin at a distance from trailing end 24 sufficient to accommodate tape strip 26. The adhesive elements extend along marginal portions 48, 50 for a further distance appropriate to provide about one full convolution of the adhesive elements around roll 10. Somewhat further along leader 22, a pair of recesses 52, 54 are provided through lateral edges 28, 30 into marginal portions 48, 50, each recess having a transverse width somewhat larger than the radial extent of peripheral portions 42 on end disks 32, 34. Although the package according to our invention preferably locates adhesive elements 42, 46 on leader 22 between trailing end 24 and recesses 52, 54 in the manner illustrated, a pair of annular adhesive elements 56 alternatively may be provided on the surfaces of end disks 32, 34 facing roll 10, as indicated schematically in dashed lines in FIG. 3. While continuous lengths of adhesive elements 44, 46 are preferred, those skilled in the art will appreciate that several shorter or intermittent lengths could be used on each side of the leader without departing from our invention, so long as the spacing between the shorter lengths does not permit the end disks to work free prematurely.

Adhesive elements 44, 46 should have a transverse width which does not exceed but preferably is slightly less than the width of peripheral portion 42, to prevent adhesive from transferring to the product or other parts of the cooperating apparatus. As previously indicated, adhesive elements 44, 46 have the property of adhering aggressively to the material of leader 22 and much less aggressively to the material of end disks 32, 34. A variety of adhesive systems may be used, including double-sided adhesive tape such as products 9415 and 9416 made by the 3M Company. Alternatively, those skilled in the art will appreciate that our adhesive elements may comprise continuous or intermittent strips of hot melt adhesive; cold seal adhesive; transfer tape; or any other combination of adhesive, leader material and end disk material which provides the previously described property of adhering much more strongly to the leader than to the end disks.

Figure 4:
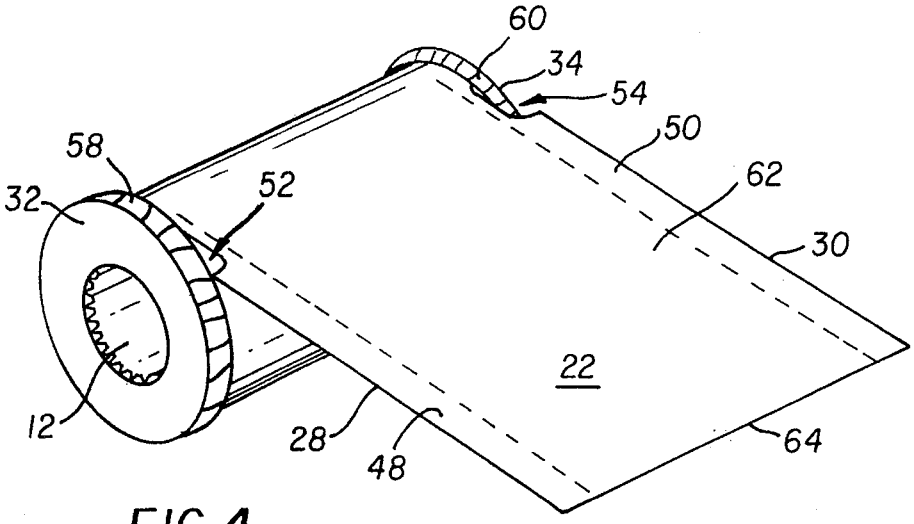
Figure 5:
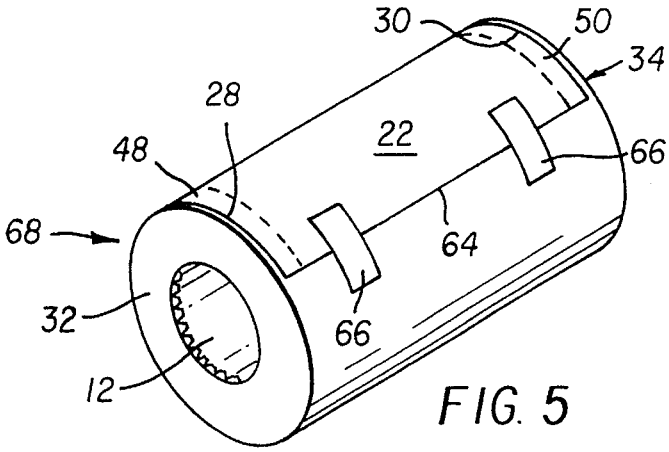

To assemble the package according to our invention, length 14 is wound onto core 12. Preferably after winding of length 14, end disks 32, 34 are attached to core 12. Leader 22 is attached to the lead end of length 14. Adhesive elements 44, 46 are applied to marginal portions 48, 50 between trailing end 24 and recesses 52, 54. If annular adhesive elements 56 are used, they may be applied to end disks 32, 34 either before or after the end disks are attached to the core. A first convolution of leader 22 is then wound around roll 10; so that, elements 42, 46 face outwardly and extend through one full convolution around the partially packaged roll. Then, peripheral portions 42 are folded over onto elements 44, 46 to form folded-over portions 58, 60 as shown in FIG. 4. Portions 58, 60 thus form a light-tight seal with adhesive elements 44, 46. The folding over may be done manually or using any convenient apparatus, such as that shown in U.S. Pat. No. 4,137,690. As portions 58, 60 are formed and leader 22 is wound around the roll, portions 58, 60 eventually progress through recesses 52, 54, thus leaving an extension 62 of leader 22 for formation of a further full or partial convolution. Any portions of adhesive elements 44, 46 which may inadvertently extend from beneath folded-over portions 58, 60 would thus be covered by the second convolution of the leader, to prevent transfer of adhesive to the cooperating cassette or apparatus. When extension 62 has been wound into place as shown in FIG. 5, its lead end 64 is secured in any convenient manner, such as by means of tape strips 66, to provide the completed light-tight package 68 according to our invention.

When package 68 is opened in a cassette or cooperating apparatus, strips 66 are removed by the operator and leader 22 is pulled away from the roll. Typically, core 12 is supported by means not illustrated which engage core 12 to permit the package to rotate as the leader is removed. In a cassette, the leader would be threaded through an exit slot and the cassette would be closed. When leader 22 has been pulled away to the extent illustrated in FIG. 4, continued pulling on the leader subjects the bonds between adhesive elements 44, 46, leader 22 and folded-over portions 58, 60 to forces which would tend to separate the adhesive bonds, tear the leader, tear the end disks or all of these. However, since the adhesive elements adhere more strongly to leader 22 than to folded-over portions 58, 60 and since the end disks and leader have sufficient tensile strength to resist tearing, the continued pulling on leader 22 causes the end disks to release from the adhesive elements without tearing and to unfold outward away from the roll. The adhesive elements move away from the roll with the leader. When the leader has been completely pulled away, the operator removes tape strip 26, discards the leader and threads leading end 20 into the cooperating apparatus, not illustrated.

Parts List

10 . . . roll of web of light-sensitive material
12 . . . core with opposite ends and length
14 . . . length of web on core, width equal to length of core
16, 18 . . . opposite end surfaces of roll as—wound
20 . . . leading end of length 14
22 . . . flexible, opaque leader, width equal to length of core
24 . . . trailing end of 22
26 . . . tape to attach 24 to 20
28, 30 . . . lateral edges of 22
32, 34 . . . flexible opaque end disks
36 . . . central portion of 32, 34
38 . . . hole through 32, 34
40 . . . radial cuts surrounding 38
42 . . . peripheral portion of 32, 34
44, 46 . . . elongated adhesive elements
48, 50 . . . lateral marginal portions of 22
52, 54 . . . recesses in 48, 50
56 . . . alternative annular adhesive element
58, 60 . . . folded-over peripheral portions
62 . . . extension of 22 beyond 52, 54
64 . . . lead end of 22
66 . . . tape strips
68 . . . completed light-tight package While our invention has been shown and described with reference to particular embodiments thereof, those skilled in the art will understand that other variations in form and detail may be made without departing from the scope and spirit of our invention.

Having thus described our invention in sufficient detail to enable those skilled in the art to make and use it, we claim as new and desire to secure Letters Patent for:

1. A light-tight package for a roll of light-sensitive web material, the roll including a core with opposite ends and a length of the web wound about the core; the roll having end surfaces at the opposite ends of the core and the length having a first width and a leading end; the package including a flexible opaque leader wound about the roll through at least a first convolution, the leader having a trailing end attached to the leading end, a second width substantially equal to the first width, a length greater than a circumference of the roll and opposite lateral edges separated by the second width; pair of flexible opaque end disks for covering the end surfaces, a central portion of each end disk being attached to the core and a peripheral portion of each end disk being folded over a circumferential edge of the first convolution of the leader, wherein the improvement comprises:

a pair of adhesive elements, the adhesive elements being located respectively between (a) each lateral edge substantially along the first convolution of the leader and (b) the folded-over peripheral portion of each end disk, each adhesive element having a property of adhering more aggressively to the leader than to the folded over peripheral portion of the end disk; and the end disks being made from a material having sufficient tensile strength to resist tearing before the adhesive elements release the folded-over portions, whereby upon unrolling of the package by pulling the leader, the end disks release from the adhesive elements without tearing and the adhesive elements move away from the roll with the leader.

2. A package according to claim 1, wherein the leader has a length greater than twice the circumference of the roll.

3. A package according to claim 2, wherein each lateral edge of the leader includes a recess extending inwardly toward a center line of the leader, the recess being spaced from the trailing end by a distance substantially equal to the circumference of the roll, the recesses providing clearance for a second convolution of the leader to pass the folded over peripheral portions of the end disks.

4. A package according to claim 1, wherein the adhesive element comprises a length of double-sided adhesive tape.

5. A package according to claim 1, wherein the adhesive elements are applied to the end disks prior to folding the peripheral portions.

6. A package according to claim 1, wherein the adhesive elements are applied to the leader prior to folding the peripheral portions.

7. A package according to claim 1, wherein the adhesive elements are intermittent along the first convolution.

* * * * *